US010472106B2

(12) United States Patent
Bartoli et al.

(10) Patent No.: US 10,472,106 B2
(45) Date of Patent: Nov. 12, 2019

(54) MACHINE AND METHOD FOR MAKING CAPSULES FOR BEVERAGES

(71) Applicant: SARONG S.P.A., Reggiolo (RE) (IT)

(72) Inventors: Andrea Bartoli, Reggio Emilia (IT); Flavio Traldi, San Prospero (IT); Alessandro Grillenzoni, San Martino in Rio (IT)

(73) Assignee: SARONG S.P.A., Reggiolo (IT)

( * ) Notice: Subject to any disclaimer, the term of this patent is extended or adjusted under 35 U.S.C. 154(b) by 341 days.

(21) Appl. No.: 15/323,487

(22) PCT Filed: Jul. 3, 2015

(86) PCT No.: PCT/IB2015/055022

§ 371 (c)(1),
(2) Date: Jan. 3, 2017

(87) PCT Pub. No.: WO2016/001883

PCT Pub. Date: Jan. 7, 2016

(65) Prior Publication Data

US 2017/0144785 A1 May 25, 2017

(30) Foreign Application Priority Data

Jul. 4, 2014 (IT) ..... B02014A0379

(51) Int. Cl.
*B65B 29/02* (2006.01)
*B26F 1/44* (2006.01)
(Continued)

(52) U.S. Cl.
CPC ..... *B65B 29/02* (2013.01); *B26F 1/44* (2013.01); *B65B 3/022* (2013.01); *B65B 9/042* (2013.01);
(Continued)

(58) Field of Classification Search
CPC ..... B65B 29/02; B65B 29/022; B65B 1/02; B65B 47/02; B65B 47/04; B65B 61/06;
(Continued)

(56) References Cited

U.S. PATENT DOCUMENTS 3,244,082 A * 4/1966 Lemelson ..... B65B 5/02 156/500
3,430,411 A * 3/1969 Ollier ..... B65B 3/027 53/296
(Continued)

FOREIGN PATENT DOCUMENTS

| | | |
|---|---|---|
| EP | 1 319 493 | 6/2003 |
| EP | 2 412 645 | 2/2012 |
| JP | 60-123305 | 7/1985 |

OTHER PUBLICATIONS

International Search Report dated Oct. 20, 2015 in International (PCT) Application No. PCT/IB2015/055022.
(Continued)

*Primary Examiner* — Alexander M Valvis
*Assistant Examiner* — Veronica Martin
(74) *Attorney, Agent, or Firm* — Wenderoth, Lind & Ponack, L.L.P.

(57) ABSTRACT

A machine for making capsules containing a product includes a forming station for forming in a sheet of thermoformable plastic material at least a casing of a capsule having a cavity, a shearing station with a punch and a die for cutting the sheet so as to separate the capsule along a respective edge, and a filling station for dosing the product into the cavity. During the cutting, the punch moves to cut the sheet with the die and then lift and detach the capsule from the sheet. The punch and the die are movable away from each other for placing the capsule on the sheet, and a through opening is created in the sheet by separating the capsule. The through opening has a passage section smaller
(Continued)

than external dimensions of the edge to allow the sheet to support and move the capsule along an advancing direction.

18 Claims, 8 Drawing Sheets

(51) Int. Cl.
*B65B 61/06* (2006.01)
*B65B 3/02* (2006.01)
*B65B 9/04* (2006.01)
*B65B 57/10* (2006.01)
*B26F 1/40* (2006.01)

(52) U.S. Cl.
CPC ..... *B65B 29/022* (2017.08); *B65B 61/065* (2013.01); *B26F 1/40* (2013.01); *B26F 2001/449* (2013.01); *B26F 2001/4472* (2013.01); *B65B 57/10* (2013.01)

(58) Field of Classification Search
CPC ..... B65B 61/065; B29C 51/445; B29C 51/00; B29C 51/26; B29C 51/30; B29C 51/32; B29C 51/44; B29C 51/266; B29C 2793/009
USPC ..... 53/453, 559, 561, 471, 281, 282
See application file for complete search history.

(56) References Cited

U.S. PATENT DOCUMENTS 3,481,100 A * 12/1969 Bergstrom ..... B65B 31/02 426/392
3,521,422 A * 7/1970 Tabor ..... B65B 7/285 53/420
3,522,687 A * 8/1970 Mahaffy ..... B65B 31/021 53/141
3,628,303 A * 12/1971 Graham ..... B29C 51/00 53/453
3,735,654 A * 5/1973 Jurasek ..... B29C 51/445 83/100
5,566,601 A * 10/1996 Mueller ..... B65B 61/065 83/123
5,582,665 A * 12/1996 Eigen ..... B29C 65/18 156/292
6,205,743 B1 * 3/2001 Castellari ..... B29C 49/24 209/597
7,467,504 B2 * 12/2008 Mate ..... B65B 35/38 206/432
7,775,017 B2 * 8/2010 Stowell ..... B29C 65/305 53/281
7,906,067 B1 * 3/2011 Rollins ..... B65D 43/0212 264/554
8,381,497 B2 * 2/2013 Scheibel ..... B65B 9/02 53/170
9,272,798 B2 * 3/2016 Lang ..... B65B 9/04
2003/0122277 A1 * 7/2003 Padovani ..... B29C 51/32 264/163
2004/0118087 A1 * 6/2004 Slaboden ..... B30B 11/027 53/453
2004/0187444 A1 * 9/2004 Hutchinson ..... B65B 3/022 53/453
2004/0247721 A1 * 12/2004 Finetti ..... B29C 49/0047 425/122
2010/0242411 A1 * 9/2010 Boekstegers ..... B65B 7/165 53/449
2010/0287889 A1 * 11/2010 Bonneville ..... B65B 9/04 53/453
2011/0165281 A1 * 7/2011 Bissoli ..... B26F 1/44 425/292

OTHER PUBLICATIONS

Written Opinion of the International Searching Authority dated Oct. 20, 2015 in International (PCT) Application No. PCT/IB2015/055022.
Notice of Reasons for Rejection dated Jun. 14, 2019 in corresponding Japanese Patent Application No. 2017-500044, with partial English-language translation.

* cited by examiner

Fig. 3
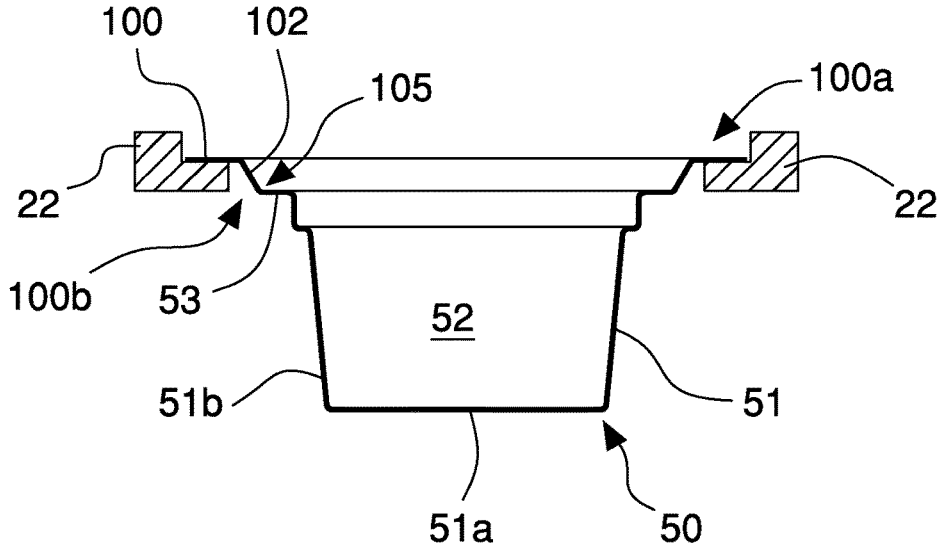
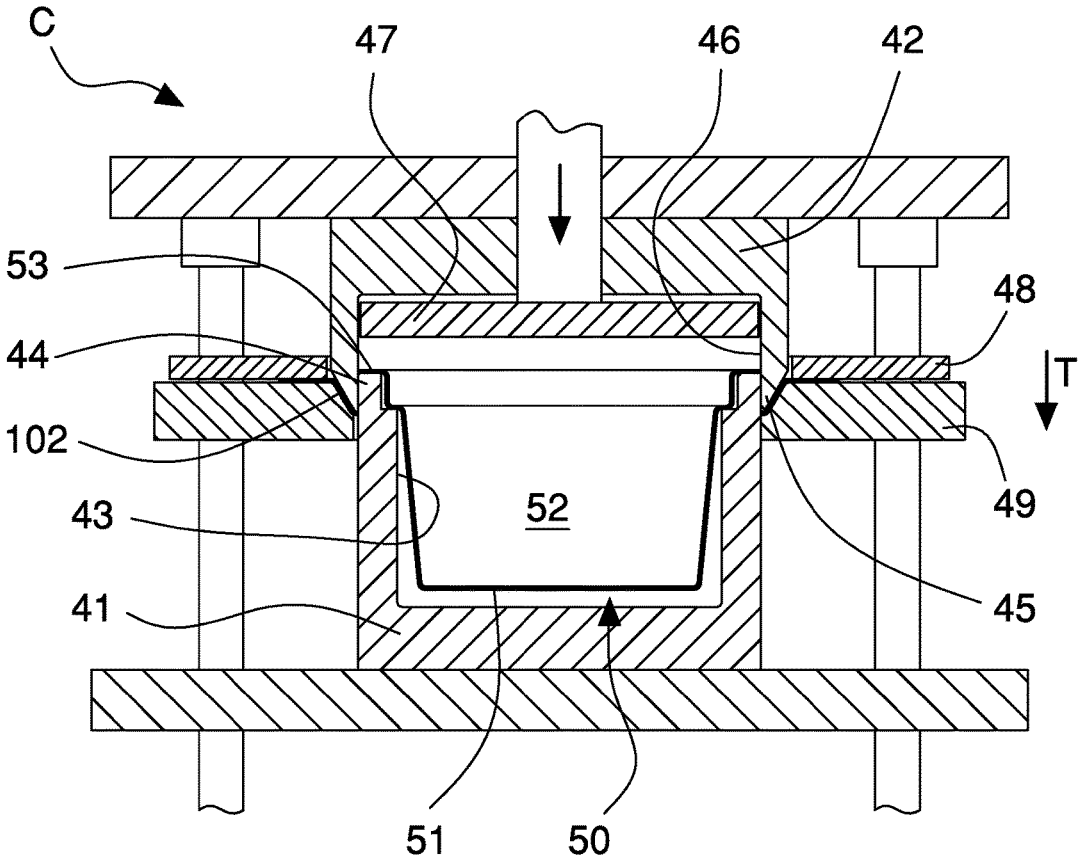
Fig. 4

MACHINE AND METHOD FOR MAKING CAPSULES FOR BEVERAGES

The present invention relates to machines and methods for making capsules for beverages. In particular, the invention relates to a machine and a method for making capsules, or similar containers, by thermoforming a plastic material sheet and for filling said capsules with a product intended for the preparation of a beverage, for example coffee or tea. The known disposable capsules for beverages typically comprise an external casing made of plastic material having a cup or bowl shape that is provided with a bottom wall and a side wall, which define an open cavity that is arranged to receive and contain the product from which the beverage is obtained. The opening of the cavity, which has an annular edge or flange, is hermetically closed by a covering element, for example an aluminum film or a multilayer plastic film, so as to close and seal the product within the cavity. The covering element and the bottom wall of the container are generally perforable for allowing to inject a pressurized liquid, for example water (through the covering element) and the extraction of the beverage which is obtained by percolation of said liquid through the product (through the bottom wall).

The casing of the capsule is carried out in thermoforming machines that comprise a plurality of operating stations through which a sheet of thermoformable plastic material, which is unwound from a reel, is advanced by suitable advancing means. The operating stations generally comprise a heating station, a forming station and a shearing station in sequence.

In the heating station the plastic sheet is prepared for the subsequent forming operation or rather is heated up to a predefined softening temperature, so as to enhance the plasticity and deformability of the plastic sheet. The forming station comprises a forming mold in which one or more punches push the sheet into respective cavities of a die so as to carrying out the casings. In the shearing station a shearing element separates the casings that are formed on the plastic material sheet, by shearing said plastic material sheet according to predefined cutting contours.

Unlike other packaging processes of containers with products and foods, the processes for making and packaging the capsules for beverages, in particular coffee, require to accurately and precisely verify the weight of the packaged capsules for verifying that the weight of the product that is dosed falls into a preset tolerance range. In order to be weighted, the capsules have to be separated from the plastic sheet and inserted separated and singularized in a suitable transport or convey system, such as a belt with seats. The weight control is necessary, in fact, for adjusting in feedback a filling or dosing station in order to limit the number of capsules to be rejected being out of tolerance.

The known integrated forming/packaging processes and machines, in which the product is dosed into cavities of the casings that are still associated with the plastic sheet and the weight control is executed after closing and detaching the capsules from the sheet, are not economically acceptable in the production of coffee capsules since they causes the rejection of many capsules. If a capsule has an out of tolerance weight, it is necessary, in fact, to reject besides said capsule, all the capsules comprised between the filling station and the weighing station, which presumably have out of tolerance weights. As the weighing station is arranged downstream of a plurality of intermediate stations, comprising typically a station for pressing the product into the capsule, a closing station, a shearing/separating station of the capsule and a station for transferring the separate capsules to the transport system, the number of capsules to be rejected is thus considerable. Furthermore, the shearing of the plastic sheet for separating the capsules after application of the covering element (by welding or sticking) determines the formation of "mixed" scrap or waste that are constituted by the plastic material of the sheet and by the metallic material of the covering element, which is generally constituted by aluminum. This "mixed" waste causes disposal problem, as the plastic and the metal have to be separated for the recycling.

For said reasons, the production processes that are currently used for the production of coffee capsules include a first step of capsules making by means of suitable thermoforming machines and a second step of capsules filling and closing by means of suitable packaging machines. More precisely, the thermoforming machines carry out the capsules by thermoforming a plastic material sheet and then separating the thus obtained capsules from the plastic sheet by shearing. The empty capsules so obtained are collected, eventually stored, for subsequently supplying the packaging machines. The packaging machines comprise a transport system, typically a roller shutter tape or similar, on which the capsules are inserted, which are picked up from a storage. Thus the capsules can be individually weighed immediately after filling with the product in order to limit the extent of the reject, the weighing station being located immediately downstream of the filling station in the packaging machine Furthermore, the plastic material waste during the thermoforming process can be completely recycled since the covering element is applied only on the capsule in the packaging machine.

This type of solution however requires using two separate machines (forming machine and packaging machine) and especially the transfer and the load of capsules on the packaging machine. The plant is therefore bulky and expensive and requires the presence of operators for introducing the capsules in the packaging machine.

The transport and the transfer of the casings from the forming machines to the packaging machine also require that said casings are inserted inside intermediate sealed packages for guaranteeing integrity and hygiene of the casings. Such intermediate packaging needs time and is expensive.

Plants or machines are also known in which the capsules that are formed and separated from the thermoforming machine, are automatically moved by transfer devices inside the packaging machine, in particular on the conveyor belt thereof. These devices are, however, rather complex and expensive and the capsule transfer and insertion operations are laborious.

An object of invention is to improve the known machines and methods for making capsules for beverages, in particular coffee capsules.

Another object is to carry out a machine that is capable to make capsules by thermoforming a plastic material sheet and then fill said capsules with a product for the preparation of a beverage, precisely and accurately controlling the weight of all the produced capsules.

A further object is to provide a machine and a method that allow obtaining material waste in the process for making the capsules that can be completely recycled.

Another further object is to provide a packaging machine that is compact, with simple and reliable operation and high productivity.

In a first aspect of the invention a machine for making capsules for beverages according to claim 1 is provided.

In a second aspect a method for making capsules for beverages according to claim 13 is provided.

The invention will be better understood and implemented with reference to the attached drawings, which illustrate some exemplifying and not limitative embodiments of the invention, in which:

FIG. 3 is a simplified cross-section of the machine according to the line of FIG. 1 that illustrates a capsule casing which is formed on a sheet of thermoformable plastic material;

FIG. 4 is a cross section of an operating shearing station of the machine of FIG. 1;

Figure 1:
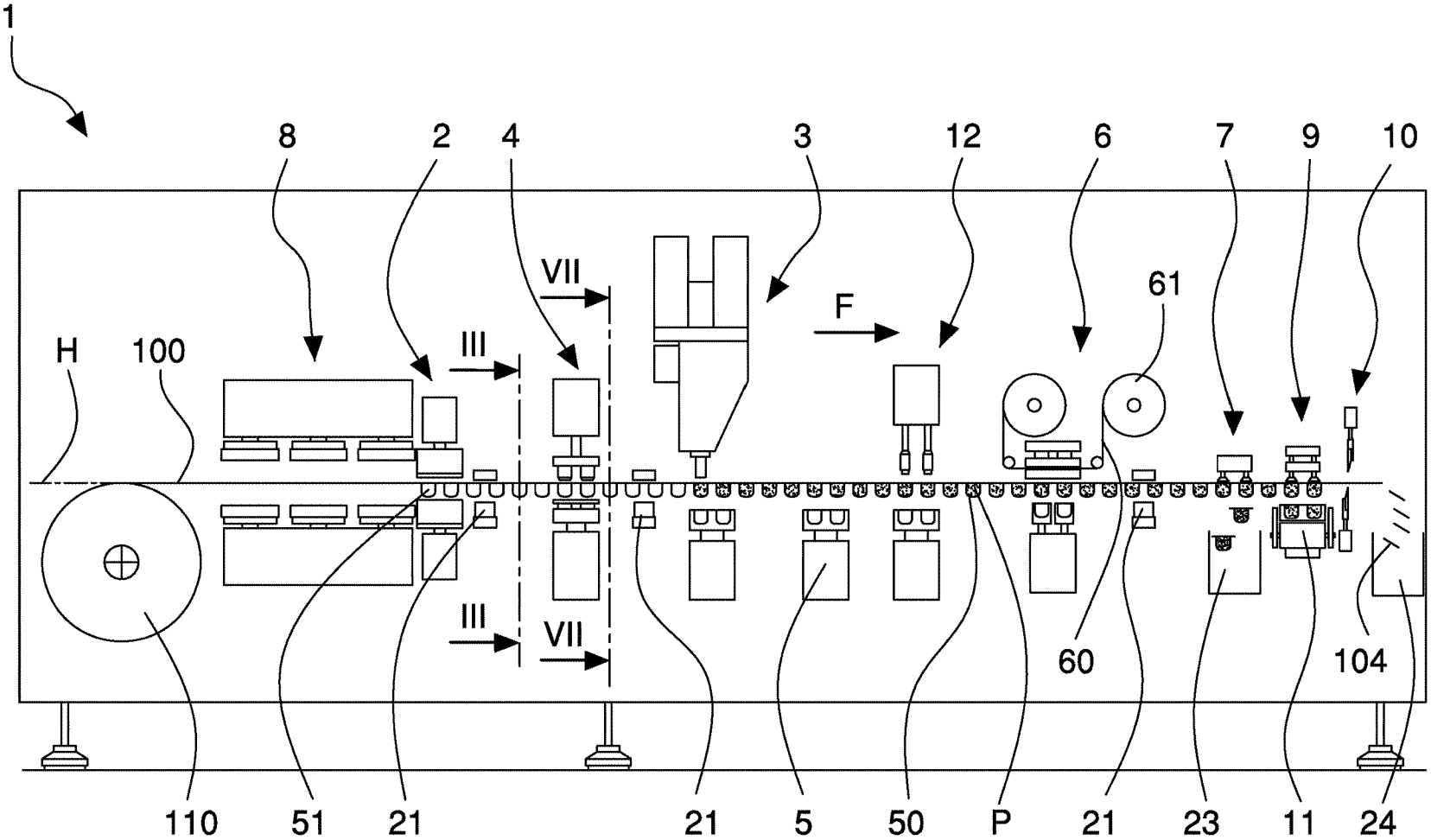
FIG. 1 is a schematic front view of the machine of the invention for making capsules for beverages.

With reference to FIG. 1, the machine 1 of the invention is schematically illustrated that is arranged to make and package capsules 50, each of which comprising a casing or container 51, in particular having a cup or bowl shape, that is provided with a cavity 52, which is arranged to receive a product P for preparing a beverage, for example coffee or tea or similar. In particular, the casing 51 of the capsule 50 comprises a bottom wall 51*a* and a side wall 51*b* that define the open cavity 52. An edge 53, which surrounds the opening of cavity 52, is fixed to the side wall 51*b* and opposite to the bottom wall 51*a*. The edge 53 comprises an annular portion having a flange shape with a flat face and, for example, circular contour. The casing 51 substantially has truncated cone shape with circular section that converges in direction of the bottom wall 51*a*.

The machine 1 comprises an operating forming station 2 for forming on a sheet 100 made of mono or multi-layer thermoformable plastic material, one or more casings 51 of the capsules 50, an operating filling station 3 for dosing the product P inside the cavities 52 of the capsules 50 and an operating shearing station 4 for separating the capsules 50 from the sheet 100. The operating shearing station 4 is interposed between the operating forming station 2 and the operating filling station 3.

The plastic material sheet 100 comprises a first side or face 100*a* and a second side or face 100*b*, said sides being flat and opposite, substantially parallel to a sliding plane H, for example horizontal. In the illustrated embodiment, the first side 100*a* is a lower side of the sheet 100, from which the thermoformed casings 51 protrude, while the second side 100*b* is an upper side of the sheet 100 in which the cavities 52 open.

An operating heating station 8 is provided upstream of the forming station 2 with reference to an advancing direction F for heating the sheet 100 up to a softening temperature of plastic material in order to allow the subsequent deformation thereof and the forming of casings 51 of the capsules 50.

The plastic material sheet 100 is moved along the advancing direction F through the various operating stations 2, 3 and 4 of the machine 1 by dragging means 21 of known type and comprising, for example, a plurality of pliers. The sheet 100 is unwound from a reel 110 and moved along the plane H with intermittent alternate motion by the dragging means 21. Guiding means 22 is provided for supporting and guiding along the advancing direction F the sheet 100. The guiding means 22 prevents movements that are transverse to said sheet 100.

The shearing station 4 comprises a punch 41 and a die 42 that are opposite and movable in approaching or in closure during a cutting step C for cutting or shearing the sheet 100 along the flange edges 53 of the casings 51 so as to separate the respective capsules 50. The punch 41 and the die 42 are moved in opposite directions along a cutting direction T that is substantially orthogonal to the sliding plane H. The flange edges 53 are arranged around the cavities 52 of the casings 51 and have a circular shape in the illustrated embodiment.

During the cutting step T, the punch 41 is movable so as to abut the lower side 100*a* of the sheet 100, cut the sheet 100 with the aid of the die 42 and then lift and detach the capsule 50 from the sheet 100, substantially creating a so-called "inverted" or "bottom-up" shearing of the sheet 100.

In a following detaching step D, the punch 41 and the die 42 are opened, i.e. mutually spaced apart, for placing the separate capsule 50 on the upper side 100*b* of the sheet 100. A through opening 101, which is carried out on the sheet 100 by separating the capsule 50, by virtue of the cutting that is performed starting from the lower side 100*a* of the sheet 100, as better explained in the following description, has a passage section A1 that is lower than external dimensions A2 of the edge 53. In other words, thanks to the greater dimensions of the edge 53, the capsule 50 resting on the upper side 100*a* of the sheet 100 is not capable to pass through the respective through opening 101 and then is supported by the sheet 100, as shown in detail in FIGS. 7-9. Therefore, the sheet 100 supports and moves along the advancing direction F, through the successive operating stations of the machine 1, said capsule 50 thus acting as a transporting or conveyor belt of the capsules 50.

Figure 5:
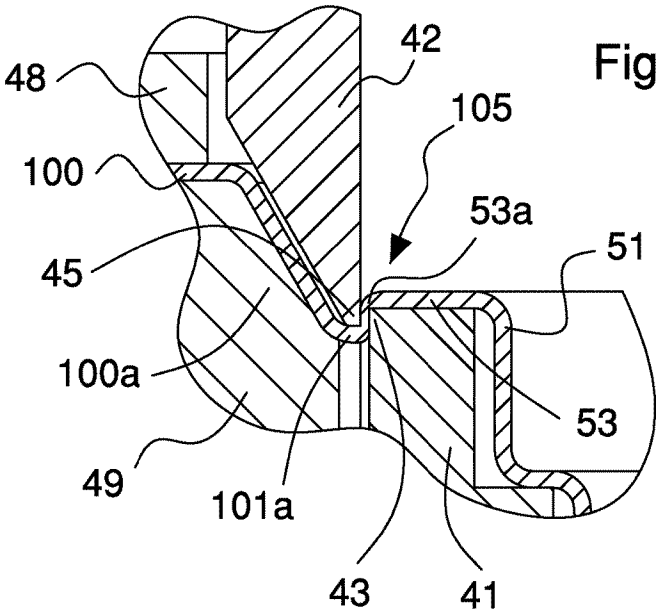
FIG. 5 is a partial enlarged view of the operating shearing station of FIG. 4 in a cutting step.
Figure 6:
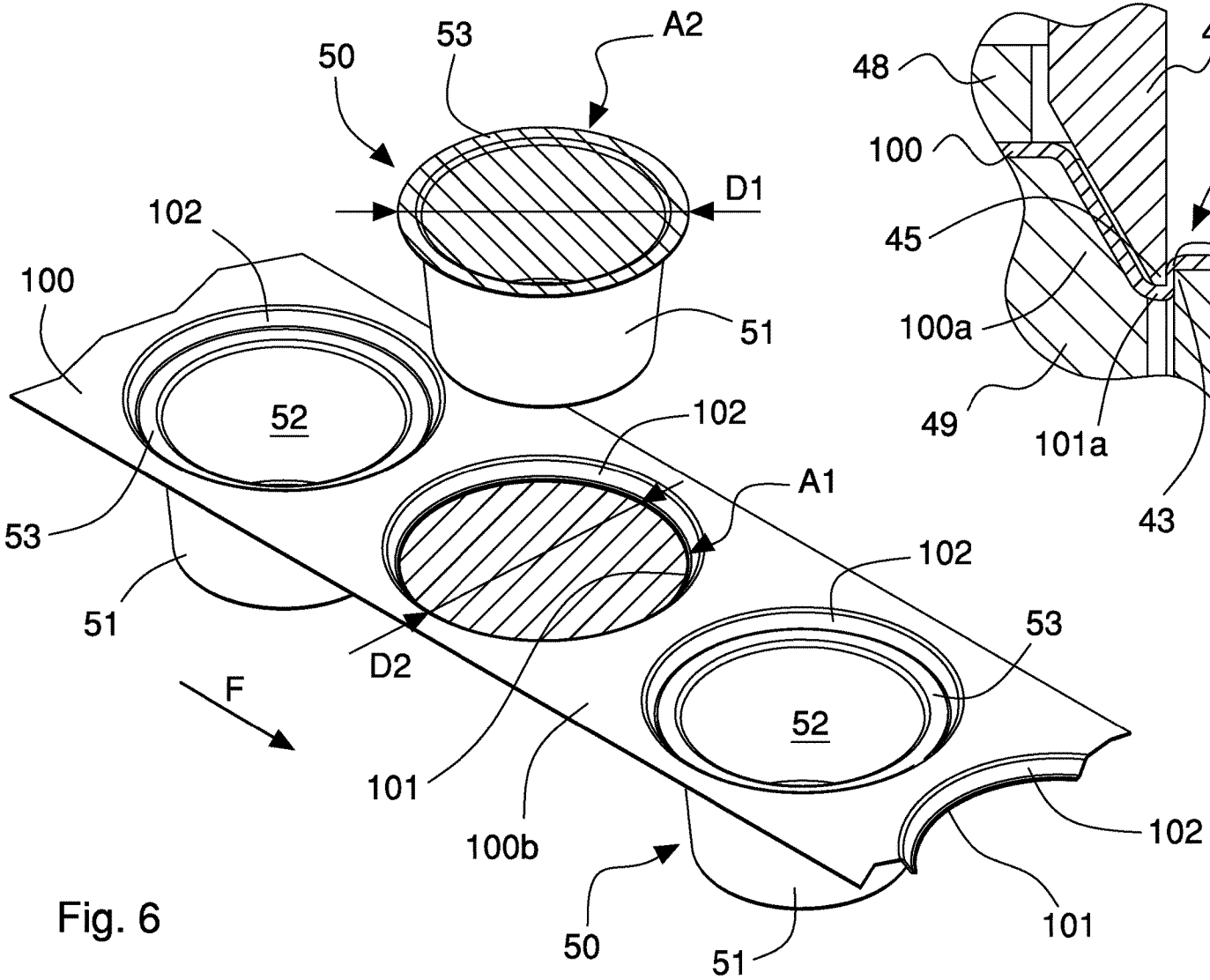
FIG. 6 is a perspective view of a capsule that is separated and spaced from the plastic material sheet and of a capsule which is supported in a respective seat on the sheet.

With particular reference to FIG. 5, the shearing or cutting of the sheet 100 causes a plastic deformation of the material in the area of the sheet that is subject to the cutting itself. More precisely, the opposite movement of cutting elements 44, 45 of the punch 41 and of the die 42 causes a localized stretching of the material in a cutting area 105, such material forming peripheral portions 101*a*, 53*a* respectively of the through opening 101 and of the corresponding edge 53 of the capsule 50. Once the cutting of the material is performed, the material remains deformed because of the plastic stretching or elongation. It is observed therefore that the dimensions of the through opening 101 and of the edge 53 of the casing 51 differ from the nominal dimensions of the cutting elements 44, 45, as a result of the material stretching.

With particular reference to FIG. 4, the punch 41 comprises at least a first housing 43 suitable to receive a respective casing 51, which is formed on the sheet 100, and the first cutting element 44 cooperating with second cutting element 45 of the die 42 for cutting said sheet 100.

The first cutting element 44 is provided with a circular cutting edge, for example with a cutting or rake angle of about 90°, while the second cutting element 45 comprises an annular circular edge, for example with a respective cutting or rake angle of about 35°. The second cutting element 45 surrounds the first cutting element 44.

The die 42 comprises at least a second housing 46 suitable to receive the casing 51 that is lifted by the punch 41 during the cutting step C, as better explained in the following description.

The die 42 also comprises an extractor device 47, which is movable along the cutting direction T inside the second housing 46 for pushing out from said second housing 46 the capsule 50 that is separated from the sheet 100 in the detaching step D. The extractor device 47 comprises, for example, a piston or pin.

The extractor device 47 may also rotate around an axis, which is parallel to the cutting direction T, for rotating the capsule 50 during the detaching step D.

The shearing station 4 also comprises blocking means 48 that is movable parallel to the cutting direction T and arranged to press and block the sheet 100 against a supporting plane 49 before performing the cutting. The blocking means 48 comprises a flat blocking plate that is provided with a respective through opening for the passage of the punch 41 and of the die 42.

Figure 8:
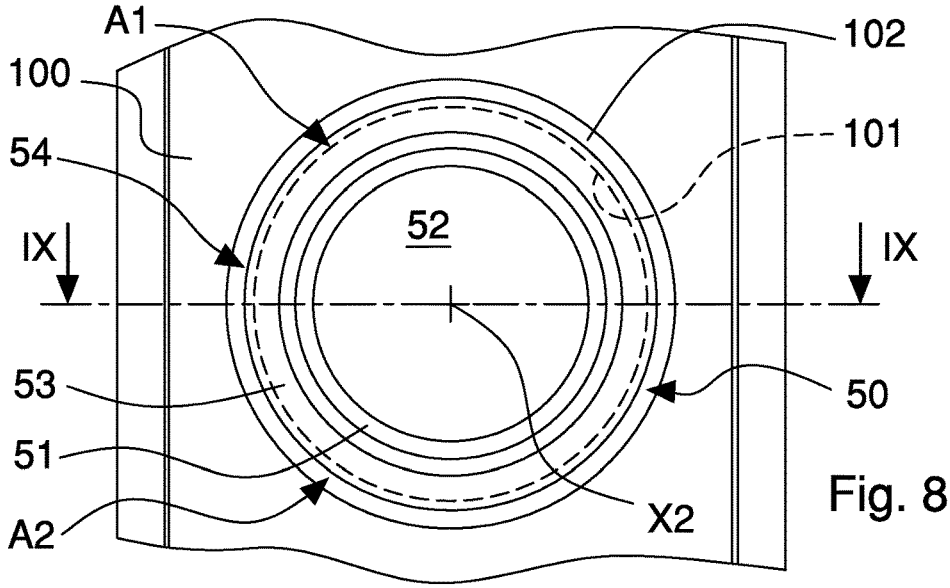
FIG. 8 is a top plan view of the capsule of FIG. 7 resting in the respective seat of the sheet.
Figure 9:
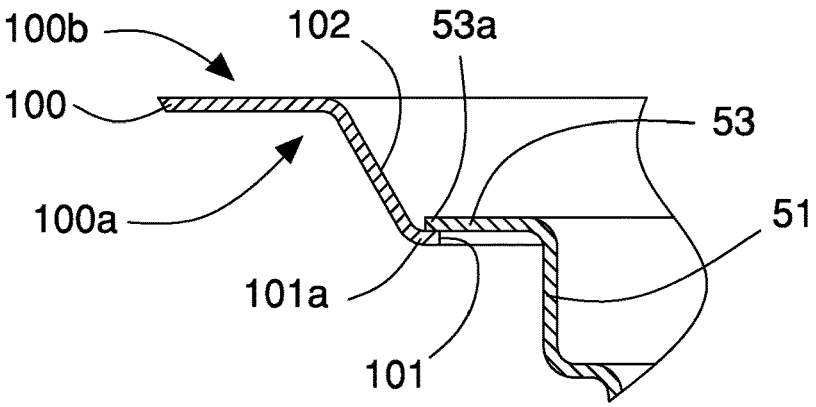
FIG. 9 is a partial section along the line IX-IX of FIG. 8.

The first cutting element 44 and the second cutting element 45 shear or cut the sheet 100 along the edge 53 of the casing 51 according a cutting line comprising a closed plane curve, such as a circumference or an ellipse. In the illustrated embodiment, the cutting line is a circumference (FIG. 8).

Figure 10:
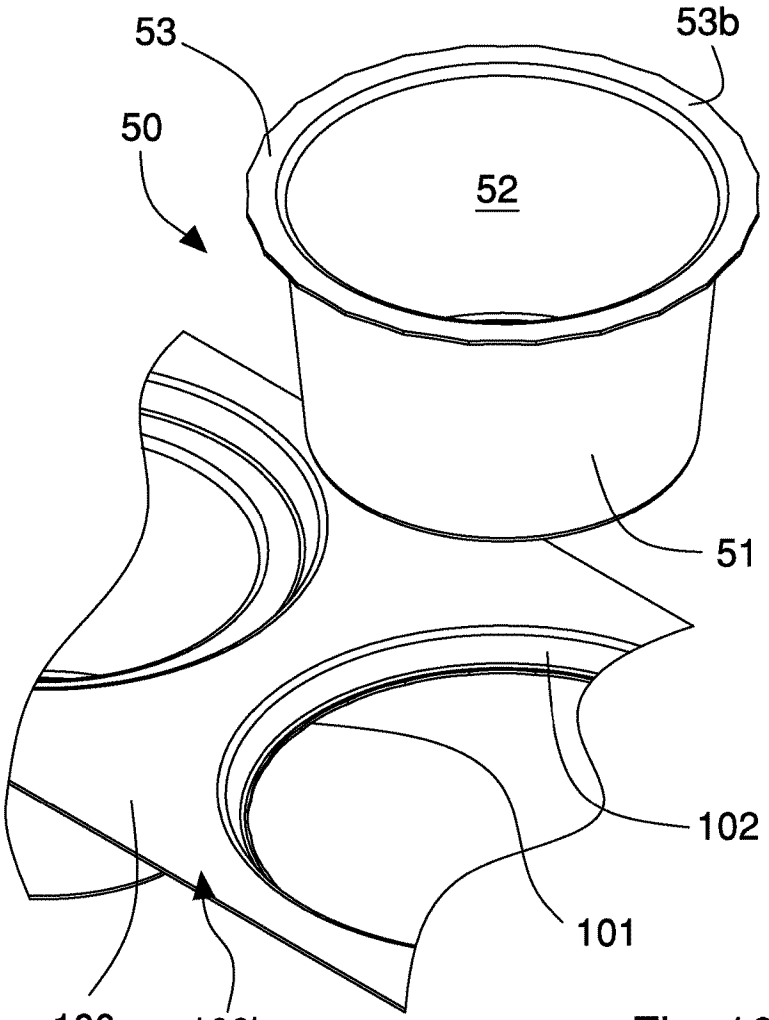
FIG. 10 is a perspective view of a variant of the capsule that is separated and spaced from the sheet and manufactured by the machine of the invention.

The cutting line may also comprise a closed broken line, in particular a polygon, as illustrated in the variant of FIG. 10.

Figure 11:
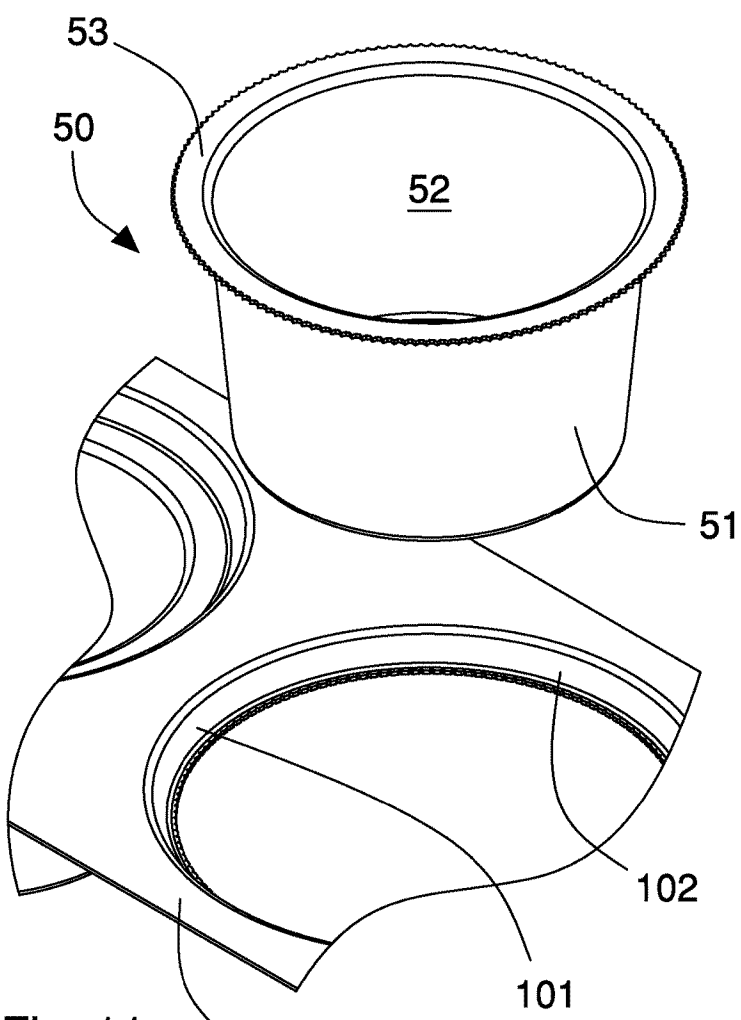
FIG. 11 is a view as the one of FIG. 10 illustrating another variant of the capsule, manufactured by the machine of the invention.

The cutting line may be continuous or jagged or serrate or notched, as illustrated in the other variant of FIG. 11.

The forming station 2 is also arranged to form on the upper side 100*b* of the sheet 100 around the cavity 52 of each casing 51 an annular recess 102, that is intended to form on the sheet 100, once the capsule 50 is separated, a seat that is suitable to receive the corresponding capsule, when said corresponding capsule is placed on the upper side 100*b* of the sheet 100. More precisely, the forming station 2 comprises forming punch means and forming die means that are arranged to deform the plastic material sheet 100, previously heated and softened in the heating station 8, so as to form the casing 51 and the respective annular recess 102. In the illustrated embodiment, the annular recess 102 has a substantially truncated cone shape with circular section and includes a side wall converging from the sliding plane H of the sheet 100 towards the casing 51. The punch 41 and the die 42 then cut the sheet 100 at a cutting area 105, which is interposed between the annular recess 102 and the edge 53.

Downstream of the operating filling station 3, with reference to the advancing direction F, an operating weighing station 5 is provided that is arranged for weighing the capsules 50 filled with product P. The weighing station 5 comprises a device for lifting and disengaging the capsules 50 from the sheet 100 and placing the capsules 50 on suitable scales or load cells, of known type and not illustrated in the figures, in order to perform an accurate and precise weight control.

The machine 1 comprises, downstream of the operating weighing station 5, an operating closing station 6 that is arranged to overlay and fix, for example by welding, a covering element to the edge 53 of each capsule 50 so as to hermetically close the product inside the respective cavity 52. The covering element is made from a film 60, for example aluminum film, that is unwound from a respective reel 61.

A operating rejecting station 7 is arranged downstream of the operating closing station 6 to withdraw from the sheet 100, and then reject possible capsules 50 filled with product P and having an out of tolerance weight. For this purpose, the machine 1 comprises a control unit, of known type and not illustrated, that controls and manages the operation of the operating stations of the machine 1 and is connected to the weighing station 5 for receiving from the latter signals related to the measured weights of the capsules 50. The measured weight values are compared with a reference value so as to identify and then reject from the production the capsules 50 which have a different weight, in excess or in defect, from the reference value (also considering the set tolerances). The control unit controls withdrawing means of the reject station, which are arranged for withdrawing from the sheet 100 that is moving through the machine 1, the capsules 50 to be rejected which are directed, for example, to a storage container 23.

An exit station 9 is provided downstream of the rejecting station 7 for withdrawing from the sheet 100 the capsules 50 filled with product P and closed, and for placing said capsules 50 on exit conveyor means 11. The exit conveyor means 11 is arranged under the sheet 100 transversely, in particular perpendicularly, to the sheet and to the advancing direction F.

The machine 1 comprises downstream of the exit station 9 a cutting station 10, which shears pieces 104 of suitable size of the sheet 100 from which the capsules 50 have been formed and separated. The broken pieces or the scraps of plastic material sheet are collected in an additional storage container 24.

In the illustrated embodiment, the machine 1 also comprises a pressing and sucking station 12, which is interposed between the operating weighing station 5 and the operating closing station 6 and in which the product P is pressed with a defined compressing force inside the capsules 50 and the product P is sucked and recovered, which is accidentally put down in the filling station 3 on the sheet 100 and/or on the flanged edges 53 of the capsules 50.

The operation of the machine 1 of the invention provides handling the sheet 100 of thermoformable plastic material along the advancing direction F through the different operating stations by the dragging means 21 with reciprocating motion.

In the forming station 2, the casings 51 of the capsules 50 are formed on the sheet 100 that is previously heated at a softening temperature of the material in the heating station 8.

After forming, the capsules 50 are individually separated from the sheet 100 in the shearing station 4. In this station, as is already described, the punch 41 and the die 42 cooperate and act so as to cut the sheet 100 along the flange edges 53 of the casings 51 in order to separate the respective capsules 50.

In the shearing step, the sheet 100 is at first blocked and pressed by the blocking plate 48 against the supporting surface 49, then the punch 41 and the die 42 are moved along the cutting direction T in opposite directions in a closing or approaching motion during the cutting step C so as to abut the sheet 100. In particular, the die 42 is lowered so as to abut the upper side 100*a* of the sheet and the punch 41 is progressively moved, in particular lifted, so as to receive in the respective housing 43 the casing 51 formed on the sheet 100, abut the lower side 100*b* thereof and then cut the sheet 100 in cooperation with the die 42. The first cutting element 44 of the punch 41 and the second cutting element 45 of the die 42 perform the cutting of the sheet 100 at the cutting area 105 interposed between the annular recess 102 and the edge 53 (FIG. 5).

During the cutting step C, the punch 41 and the capsule 50, which is thus obtained and housed in the first housing 43, are progressively moved along the cutting direction T and inserted inside the second housing 46 of the punch 41. At the end of the cutting step C, the capsule 50 is completely detached from the sheet 100.

At this point, in the successive detaching step D, the punch 41 and the die 42 are opened and moved along the cutting direction T away from each other and from the sheet 100. The extractor device 47 is driven to push out the capsule 50 from the second housing. The capsule 50 falls on the top side 100*b* of the sheet 100 within the annular seat formed by the recess 102 surrounding the through opening 101 obtained on the sheet 100 by shearing the respective capsule 50.

The opposite movement of the cutting elements 44, 45, in fact, during the cutting step C, causes a localized stretching of the material of sheet 100 in the cutting area 105. Due to this plastic deformation, the material of the sheet 100 in said cutting area 105 remains deformed also at the end of the cutting. In particular, the peripheral portions 101*a*, 53*a*, respectively of the through opening 101 and the corresponding edge 53, are stretched in a direction that is transversal to the cutting direction T, i.e. with reference to the illustrated embodiment, in a radial direction. Because of the stretching, dimensions of the through opening 101 and of the edge 53 of the casing 51 differ from the nominal dimensions of the cutting elements 44, 45. Furthermore, it is observed that the passage section Al of the through opening 101 is smaller than external dimensions A2 of the edge 53. In the case of a circular shape cutting, as in the illustrated example, a first diameter D1 of the edge 53 is bigger than a second diameter D2 of the respective through opening 101, so that the capsule 50 can rest on the upper side 100*a* of the sheet 100 along a circular crown 54 having a width that is equal to (D1-D2)/2.

Several tests, performed by the applicant with different types and thicknesses of the plastic material sheet (mono and multilayer) and different operating cutting parameters (cutting speed, rake angles of the cutting elements, temperature of the sheet, etc.) clearly show how, as consequence of the shearing that is performed by the punch 41 by acting on the lower side 100*a* of the sheet 100 by contextually lifting upwards the capsule 50 in the direction of the upper side 100*b*, a material deformation is obtained that leads to have dimensions of the through opening 101 and of the edge 53 of the capsule which are greater than the dimensions of the cutting elements 44, 45 of the punch 41 and the die 42.

By way of not limitative example, by forming a multilayer sheet of polypropylene having a barrier layer and a thickness of 0,75 mm, by using the first cutting element 44 of the punch 41, having circular shape with a diameter comprised between 47.02 mm and 46.98 mm ($\Phi=47^{\pm 0.02}$ mm), a through opening 101 is carried out that has an internal diameter D2=46.75 mm and a capsule with flange edge 53 having an outer diameter D1=47.1 mm, for an interference value or diametrical difference equal to 0.35 mm.

By repeating the test with a multilayer sheet of polypropylene with barrier layer and thickness of 1.2 mm, by using the first cutting element 44 having circular shape with a diameter comprised between 41.62 mm and 45.58 mm ($\Phi=41.6^{\pm 0.02}$ mm), a through opening 101 is carried on the sheet that has an internal diameter D2=46.45 mm and a capsule with flange edge 53 having an outer diameter D1=41.7 mm, for a value of interference or diametrical difference equal to 0.25 mm. Therefore, in the case of circular shaped cutting with a diameter of the first cutting element 44, which is comprised between 40-50 mm and thicknesses of the sheet which is comprised between 0.75 and 1.2 mm, the capsule 50, once is separated and then deposited on the upper side 100*a* of the sheet 100, rests on the sheet 100 along a circular crown 54 having a width comprised between 0.12 and 0.18 mm. The interference or difference of the diametrical dimensions thus prevents the capsule 50 from falling out of the sheet 100 through the through opening 101.

Figure 7:
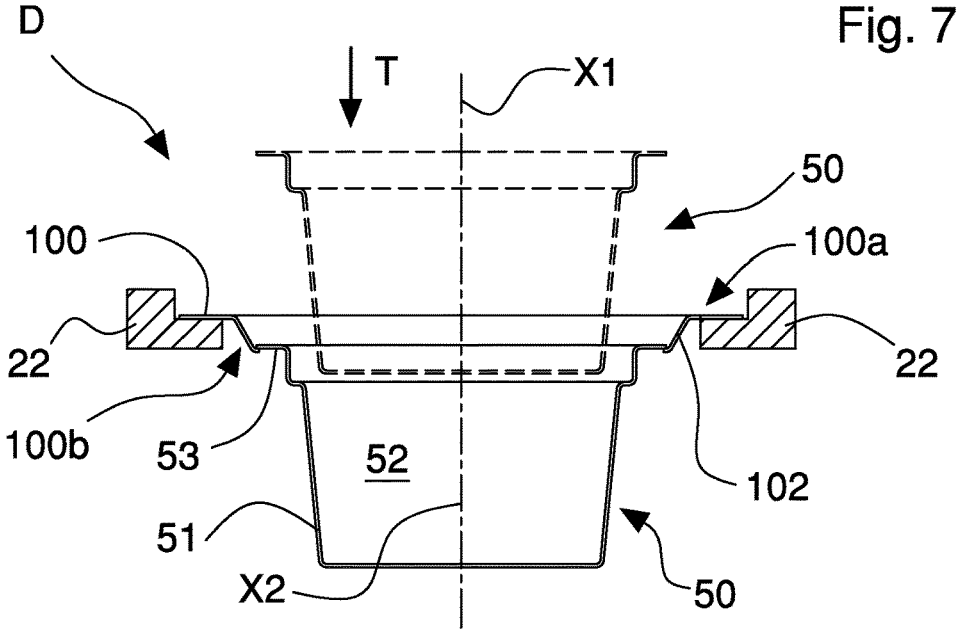
FIG. 7 is a partial section along the line VII-VII of FIG. 1 in which a capsule is shown that is inserted in the respective seat and, illustrated in a dotted line, spaced apart from the sheet in a detachment step.

It has to be noted that the annular seat formed by the annular recess 102 allows precisely positioning and centering the capsule 50 on the sheet 100. As illustrated in FIG. 7, the edge 53 in the detaching step D abuts the conical wall of the annular recess 102 and is placed by gravity on an annular edge of the through opening 101, a longitudinal axis X1 of the capsule 50 being substantially aligned and coaxial to a central axis X2 of said through opening 101. Hence, thanks to the annular recesses 102, the capsules 50 can be moved and positioned with relative precision at the operating stations that follow the shearing station 4. In such operating stations, however, centering means is provided for positioning the capsules 50 in a precise and correct manner in order to perform the required operations, such as filling with the product P, compression of product P, closure with the covering element.

In the operating weighing station, the capsules 50 are picked up by suitable means from the sheet 100 and positioned on scales or load cells for measuring the weight.

The method according to the invention for making capsules 50 containing a product P for preparing a beverage, comprises the steps of:

- moving a sheet 100 of thermoformable plastic material along an advancing direction F;
- forming on the sheet 100 at least a casing 51 of a capsule 50 that is provided with a cavity 52 suitable for receiving the product P, the casing 51 protruding from a first side 100*a* of the sheet 100 and the cavity 52 being open on a second side 100*b* of the sheet 100 that is opposite to the first side 100*a;*
- separating the capsule 50 from the sheet 100 by abutting the first side 100*a* of the sheet 100, by cutting the sheet 100 along an edge 53 of the capsule 50 and by lifting and detaching the capsule 50 from the sheet 100;
- placing the separate capsule 50 on the second side 100*b* of the sheet 100, a through opening 101, which is carried out on the sheet 100 by detaching the capsule 50, having a passage section A1 that is smaller than external dimensions A2 of the edge 53 for allowing the sheet 100 to support and move the capsule 50 along the advancing direction F;

dosing the product P inside the cavity 52.

The method provides dosing the product P after placing the capsule on the sheet 100.

It is also provided to form on the second side 100*b* of sheet 100 around the cavity 52 an annular recess 102 which is intended to carry out on the sheet 100, once the capsule 50 has been separated, a seat suitable to receive said capsule 50 that is released on the sheet 100. Then it is provided to cut the sheet 100 at a cutting area 105 that is interposed between the annular recess 102 and the edge 53.

The method also provides to cut the sheet 100 along the edge 53 according to a cutting line comprising a closed plane curve, in particular a circumference or an ellipse, or a closed broken line, in particular a polygon or according to a jagged or serrate or notched cutting line.

In lifting and detaching the capsule 50 from the sheet 100 during the cutting step, it is also provide to rotate the capsule 50 around a respective longitudinal axis X1.

The method of the invention, after the filling with the product P, comprises weighing the capsule 50 so filled, overlapping and fixing a covering element to the edge 53 so as to close hermetically the product P inside said cavity 52.

Therefore, the machine and method of the invention allow making capsules 50 by forming a sheet of thermoformable plastic material and filling said capsules with a product P for preparing a beverage, performing a precise and accurate weight control of all the produced capsules.

More precisely, thanks to the punch 41 and the die 42 of the shearing station 4 of the machine 1 and thanks to the operation mode thereof, it is possible to separate the capsules 50, which are previously formed from the sheet 100 (for allowing afterwards the capsules 50 to be filled with product and weighed), and to use the same sheet 100 as transport means for moving said capsule 50 through the operating stations of the machine 1 in the advancing direction F.

The so-called "inverted" shearing (in which the punch 41 acts on the lower side 100*a* of the sheet 100 and lifts the sheared capsule 50 in the cutting step C) allows obtaining a through opening 101 having a passage section A1 (with a first diameter D1 in case of circular shape) smaller than external dimensions A2 (with a second diameter D2 in case of circular shape) of the edge 53 of the respective capsule 50, which rests on the upper side 100*a* of the sheet 100 and is supported by said sheet 100. More precisely, the edge 53 abuts the annular conical wall of the recess 102 so that the capsule 50 is positioned by gravity aligned with the through opening 101.

The machine 1 of the invention is particularly compact and with a simple structure since it neither includes specific transporting and handling means of the single capsules (such as belt or similar) nor requires means for transferring the separated capsules from the sheet 100 to said transporting means. By using the plastic material sheet 100 as a transport means, the machine 1 of the invention further has a simple and reliable functioning and high productivity.

It should be noted also that since the covering element (aluminum film) is fixed to the edge 53 of the capsules 50 only after the detachment from the sheet 100, the scraps 104 thereof—obtained by cutting and fragmenting the sheet 100 that is provided of through openings 101—are constituted only by the plastic material of the sheet and can be completely recovered and recycled.

With particular reference to FIGS. 10 to 14, variants of the machine and of the method of the invention are provided that allow obtaining different capsules 50 and related through openings 102 on the sheet 100. More precisely, by using suitable cutting elements 44, 45 of the punch 41 and the die 42, it is possible to vary the cutting line that is executed on the sheet 100.

With reference to FIG. 10, the edge 53 and the through opening 101 can be obtained by a cutting line which comprises a closed broken line so as to form a polygon. In particular, the edge 53 presents a peripheral contour 53*b* comprising a plurality of straight sides that are joined to form a polygon. The through opening 101 comprises a respective peripheral contour having the shape of a polygon, which is complementary to the one of the edge 53. With reference to FIG. 11, the cutting line may be jagged or serrate or notched so as to carry out an edge 53 and a through opening 101 with a substantially circular shape, but provided with a serrate profile rather than smooth.

Figure 13:
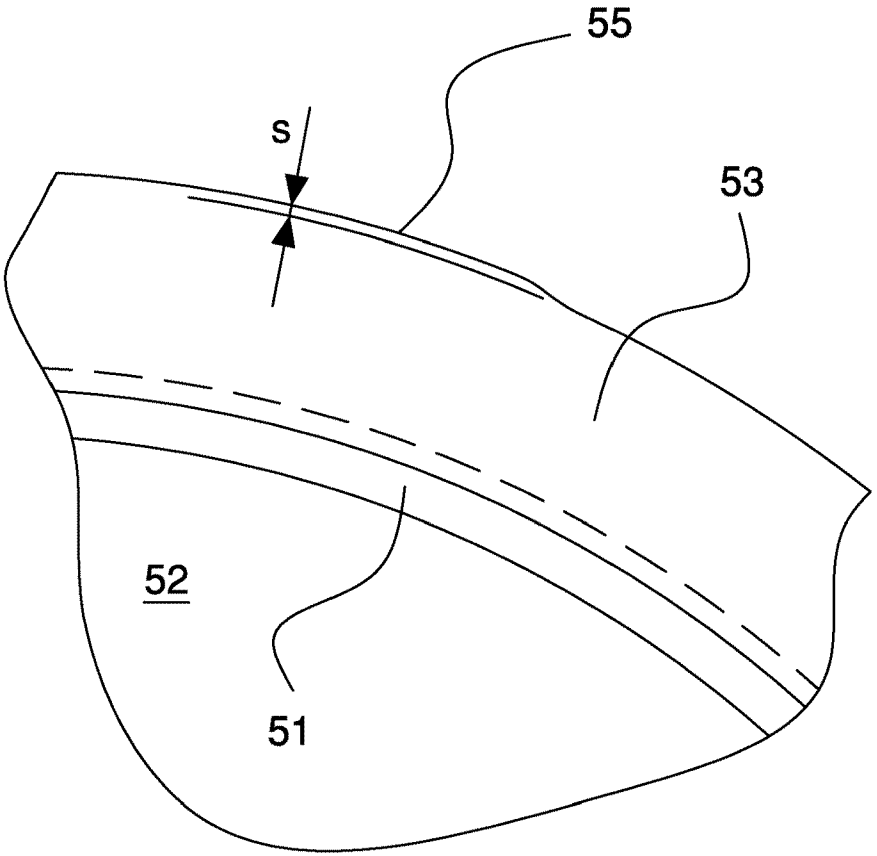
FIG. 13 is an enlarged detail of the capsule of FIG. 14, emphasizing in particular a shaped portion of an edge of said capsule.
Figure 12:
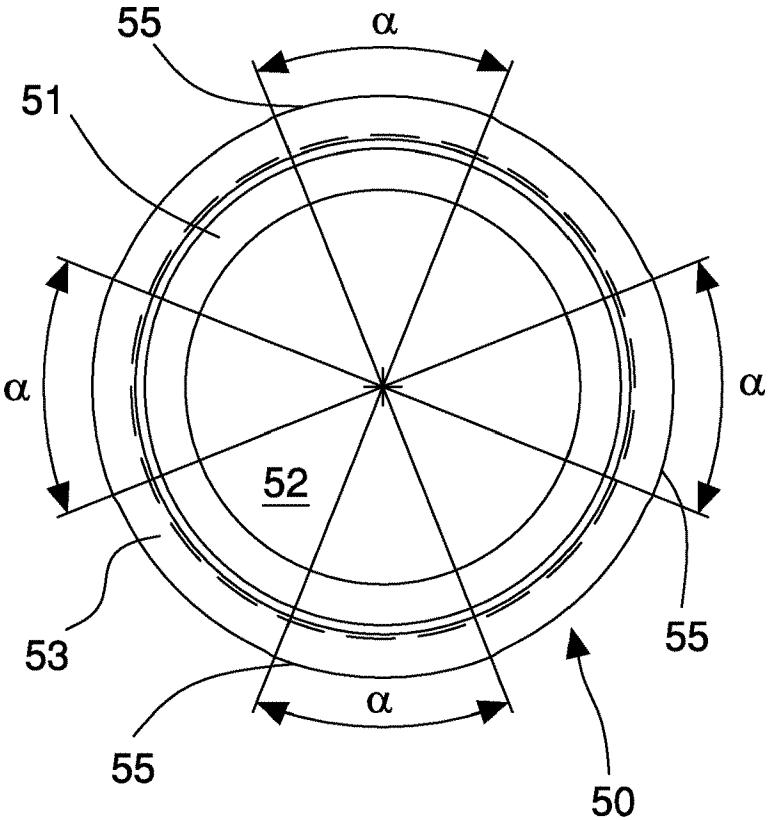
FIG. 12 is a top plan view of a further variant of the capsule that is manufactured by the machine of the invention.

With reference to FIGS. 12 and 13, the cutting line may further comprise a closed continuous line that forms on the edge 53 a plurality of projecting portions 55 and on the corresponding through opening 101 a plurality of indented portions 105 that are complementary to said projecting portions 55. In the illustrated example, the projecting portions 55 are substantially circular sectors that have a defined angular width $\alpha$ which is equal for example to 45°, and protrude by a defined amount s, for example 0.2 mm, from the edge 53. The projecting portions 55 are, for example, four in number and are angularly and regularly spaced apart (of 90°). Likewise, the indented portions 105, complementary to the projecting portions 55, are four, angularly and regularly spaced apart. The number, the angular width $\alpha$ and the amount s of the projecting portions 55 may vary.

The variants of FIGS. 10 to 13 ensure a greater dimension or amplitude of the circular crown 54 along which the capsule 50 rest on the sheet 100.

In particular, by rotating the capsule 50 around its longitudinal axis X1 during the cutting step C or during the detaching step D, it is possible to more effectively overlay the edge 53 on the through opening 101 of the sheet since the protrusions of the respective flange edges 53—which are formed by the polygon edges, the profile teeth, the projecting portions 55—overlays the sheet 100.

Figure 15:
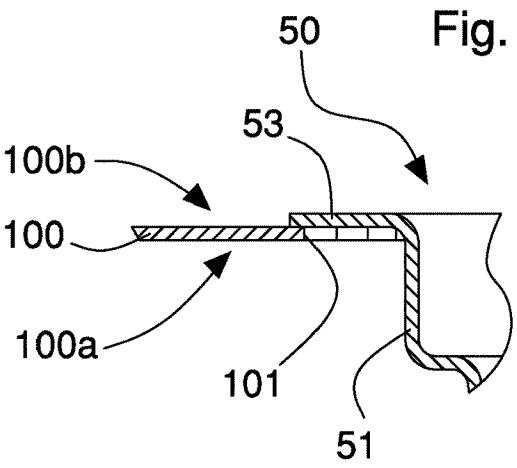
FIG. 15 is an enlarged partial section that illustrates the capsule of FIG. 12 resting on and supported by the sheet.
Figure 14:
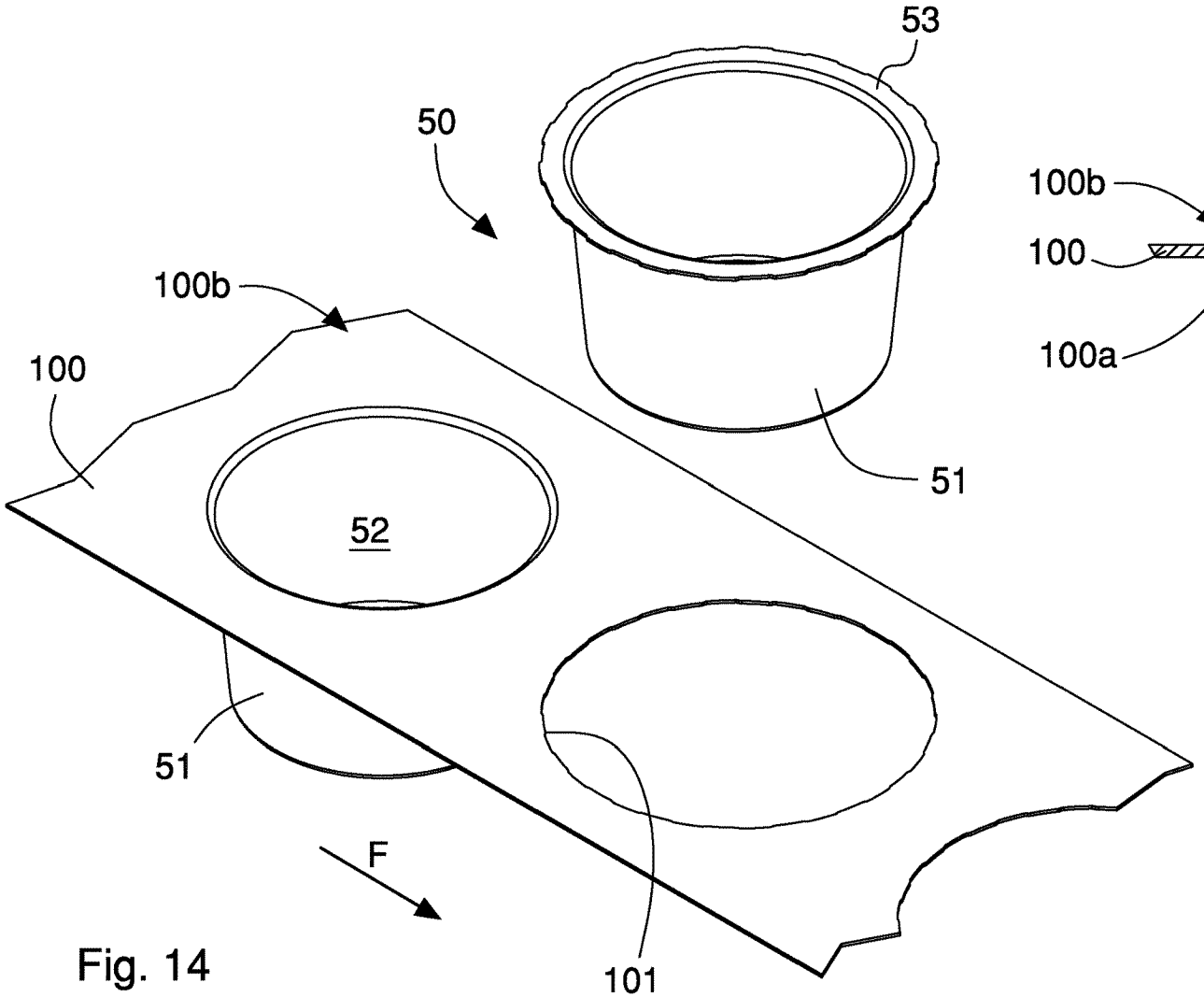
FIG. 14 is a perspective view of another further variant of the capsule that is manufactured by the machine of the invention.

With reference to FIGS. 14 and 15, additional variants of the machine and of the method of the invention are provided that differ from the previously described and illustrated embodiments in that no annular recess 102 that is intended to form a seat is carried out on the sheet 100 and the capsule 50, after the separation by cutting, is placed on the upper side 100*b* of the sheet 100. In this case, during the sheet displacement along the advancing direction F, the capsule 50, although supported by the sheet 100, can move inside the through opening 101 due to the clearance that exists between the opening 101 and the side wall 51*b* of the casing 51. However in the operating stations suitable centering means is provided for positioning the capsules 50 in a precise and correct manner in order to perform the requested operations. With reference to the example of FIGS. 12 and 13, the edge 53 and the through opening 101 are obtained with a cutting line comprising a closed broken line so as to form a polygon for carrying out a greater dimension or width of the circular crown on which the capsule 50 rests on the sheet 100.

Figure 2:
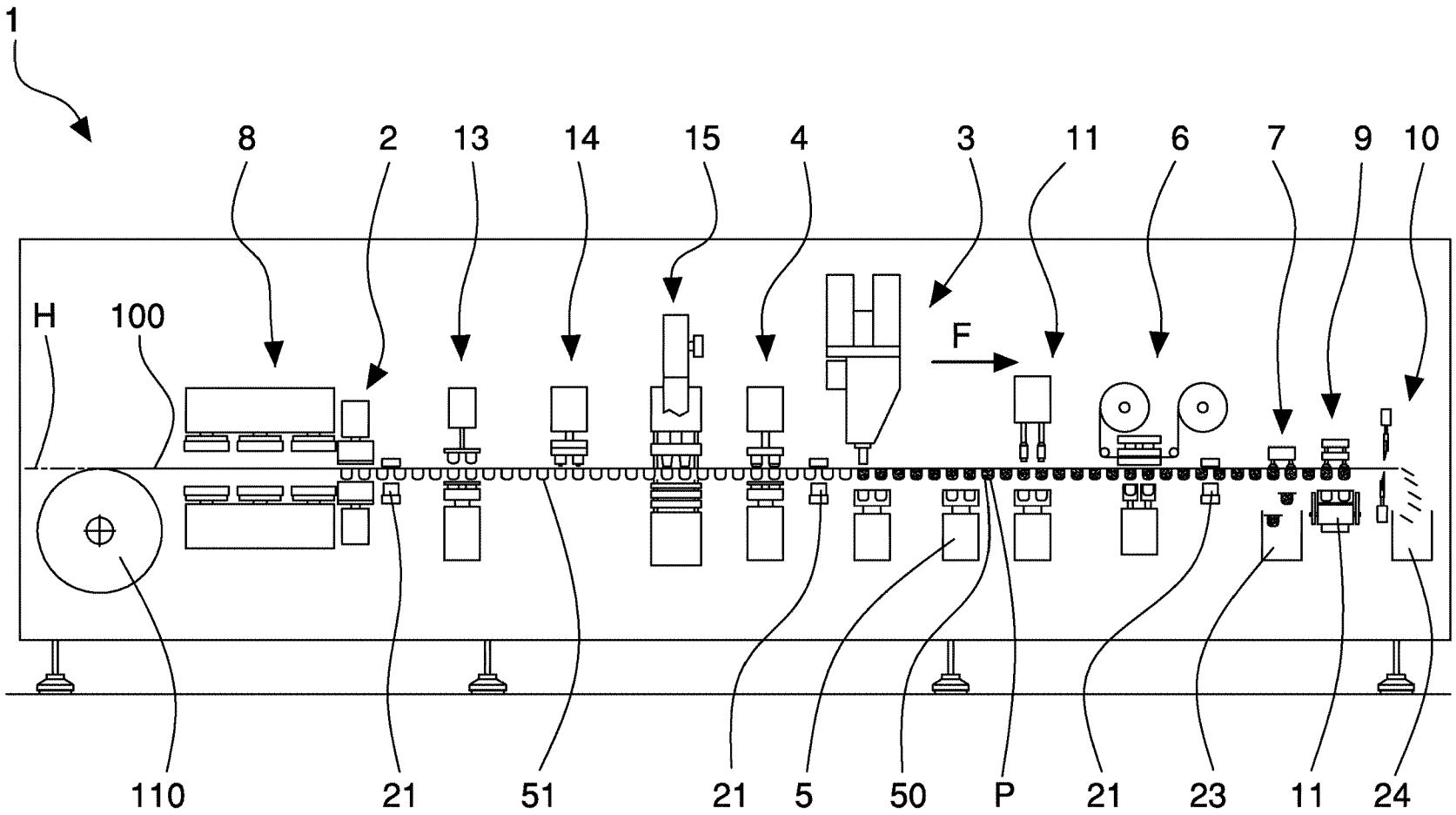
FIG. 2 is a schematic front view of a variant of the machine of FIG. 1.

FIG. 2 illustrates a variant of the machine 1 of the invention, which differs from the embodiment previously described and shown in FIG. 1, in that it comprises a plurality of further operating stations suitable to perform respective operations on the sheet 100 and/or on the capsule 50. More precisely, downstream of the forming station 2 and before the shearing station 4, there are provided in sequence: a first control station 13 for verifying the correct forming of the casings 51 on the sheet 100 of plastic material, a drilling station 14 for carrying out an exit hole on the bottom wall 51*a* of the casing 51 (for the beverage outflow when using the capsule 50) and a further closing station 15 for applying a covering element of the exit hole on the bottom wall 51*a* of the casing 51.

The operation of this variant of the machine 1 of the invention is substantially identical to the one of the machine of FIG. 1 which is above described.

The invention claimed is:

1. A machine for making capsules that contain a product for preparing a beverage, the machine comprising:

a forming station for forming at least a casing of a capsule in a sheet that is made of thermoformable plastic material and is movable along an advancing direction, where the casing has a cavity and projects from a first side of the sheet, and the cavity is open on a second side of the sheet;

a shearing station provided with a punch and a die that oppose each other and are movable to approach each other, during a cutting operation, for cutting the sheet so as to separate the capsule along an edge of the capsule and creating a through opening in the sheet; and a filling station for dosing the product inside the cavity, wherein said punch during the cutting operation is movable so as to abut the first side of the sheet, cut the sheet in cooperation with said die, and then lift and detach the capsule from the sheet, wherein said punch and said die in a detaching operation are movable away from each other for placing the capsule on the second side of the sheet, and wherein the through opening is created in the sheet by separating the capsule, the through opening having a passage section that is smaller than external dimensions of the edge in order to allow the sheet to support and move the capsule along the advancing direction.

2. The machine according to claim 1, wherein said shearing station is interposed between said forming station and said filling station.

3. The machine according to claim 1, wherein said punch comprises at least a first housing suitable for receiving a respective casing formed from the sheet and a first cutting element that cooperates with a second cutting element of said die for shearing the sheet.

4. The machine according to claim 3, wherein said die comprises at least a second housing suitable for receiving a respective casing lifted by said punch during the cutting operation.

5. The machine according to claim 4, wherein said die comprises an extractor device that is movable within said second housing in order to push the capsule out from said second housing in the detaching operation.

6. The machine according to claim 1, wherein said forming station is arranged to form an annular recess on the second side of the sheet and around the edge, and, once the capsule is separated from the sheet, the annular recess forms a seat suitable for receiving the capsule when placed on the sheet.

7. The machine according to claim 6, wherein said punch and said die are arranged for cutting the sheet at a cutting area) that is interposed between the annular recess and the edge.

8. The machine according to claim 1, wherein said punch and said die respectively comprise a first cutting element and a second cutting element that are arranged for cutting the sheet along the edge according to at least one of a cutting line that comprises a closed plane curve or a closed broken line, and a serrate or notched cutting line.

9. The machine according to claim 1, wherein said punch and said die respectively comprise a first cutting element and a second cutting element that are arranged for cutting the sheet along the edge according to a cutting line that comprises a closed plane curve such as to form on the edge a plurality of projecting portions and on the corresponding through opening a plurality of indented portions that are complementary to the projecting portions.

10. The machine according to claim 1, further comprising a weighing station that is positioned downstream of said filling station with reference to the advancing direction, is arranged for weighing the capsule filled with product, and comprises a device for lifting and disengaging the capsule from the sheet.

11. The machine according to claim 1, further comprising a closing station to overlap and fix a covering element to the edge so as to hermetically seal the product (P) inside the cavity.

12. The machine according to claim 1, further comprising a reject station to pick up from the sheet and then reject a capsule filled with product that has a weight that is out of tolerance.

13. A method for making capsules that contain a product for preparing a beverage, the method comprising:

moving a sheet of thermoformable plastic material along an advancing direction;

forming in the sheet at least a casing of a capsule that has a cavity suitable for receiving the product, wherein the casing projects from a first side of the sheet and the cavity is open on a second side of the sheet;

separating the capsule from the sheet by abutting with cutting elements the first side of the sheet, cutting the sheet along an edge of the capsule, and lifting and detaching the capsule from the sheet;

creating a through opening in the sheet by detaching the capsule, wherein the through opening has a passage section that is smaller than external dimensions of the edge to enable the sheet to support and move the capsule along the advancing direction;

placing the capsule on the second side of the sheet; and filling the cavity with the product after said placing.

14. The method according to claim 13, wherein said forming further comprises forming on the second side of the sheet around the cavity an annular recess, wherein the annular recess forms a seat suitable for receiving the capsule when placed on the sheet, once that the capsule is separated from the sheet.

15. The method according to claim 14, further comprising cutting the sheet at a cutting area that is interposed between the annular recess and the edge.

16. The method according to claim 13, further comprising cutting the sheet along the edge according to at least one of a cutting line that comprises a closed plane curve or a closed broken line, a serrate or notched cutting line and a cutting line that comprises a closed plane curve such as to form on the edge a plurality of projecting portions and on the corresponding through opening a plurality of indented portions that are complementary to the projecting portions.

17. The method according to claims 13, wherein said lifting and detaching of the capsule from the sheet further comprises rotating the capsule around a respective longitudinal axis.

18. The machine according to claim 9, wherein the projecting portions comprise circular sectors that have a defined angular width, protrude a defined amount from the edge, and are angulary and regularly spaced apart from each other.

* * * * *